US008069622B2

(12) United States Patent
Mees et al.

(10) Patent No.: US 8,069,622 B2
(45) Date of Patent: Dec. 6, 2011

(54) SYSTEMS AND METHODS FOR FINISHING A PENETRATION IN A CONCRETE STRUCTURE DURING CONSTRUCTION

(75) Inventors: Geoffrey Claude Mees, Mehlville, MO (US); Timothy A. Ellecbracht, St. Louis, MO (US)

(73) Assignee: All-Terior Systems LLC, St. Louis, MO (US)

( * ) Notice: Subject to any disclaimer, the term of this patent is extended or adjusted under 35 U.S.C. 154(b) by 0 days.

(21) Appl. No.: 12/372,564

(22) Filed: Feb. 17, 2009

(65) Prior Publication Data

US 2010/0043321 A1 Feb. 25, 2010

Related U.S. Application Data

(60) Provisional application No. 61/028,775, filed on Feb. 14, 2008.

(51) Int. Cl.
*E06B 3/00* (2006.01)
*E04C 2/38* (2006.01)

(52) U.S. Cl. ..... 52/213; 52/217; 52/656.9

(58) Field of Classification Search ..... 52/204.1, 52/213, 216, 217, 745.16, 745.15, 656.9, 52/656.2, 656.7, 656.4, 656.5
See application file for complete search history.

(56) References Cited

U.S. PATENT DOCUMENTS 451,596 A * 5/1891 Longenecker ..... 52/656.9
1,782,695 A 11/1930 Prez
1,808,337 A 6/1931 Baum
1,856,150 A * 5/1932 Baum ..... 52/216
1,863,730 A 6/1932 Ross
1,924,971 A 8/1933 Baum
1,994,976 A 3/1935 Wread
2,101,349 A * 12/1937 Sharp ..... 403/280
2,686,422 A 8/1954 Parrish, Jr. et al.
2,741,344 A * 4/1956 Herr ..... 52/211
2,742,117 A * 4/1956 Tolman ..... 49/399
(Continued)

FOREIGN PATENT DOCUMENTS

CA 2255256 1/2000
(Continued)

OTHER PUBLICATIONS

Vinyl Technologies, Inc., available at web-page http://www.vbuck.com, Oct. 18, 1999.

*Primary Examiner* — Brian Glessner
*Assistant Examiner* — Beth Stephan
(74) *Attorney, Agent, or Firm* — Polster, Lieder, Woodruff & Lucchesi, L.C.

(57) ABSTRACT

Jamb connectors for finishing a penetration in concrete or masonry construction, the jamb connectors coupling a first jamb with a second jamb that is adjacent to the first jamb and having a first portion with two segments lying substantially in a same plane and positioned at a predetermined angle from each other, each first portion segment being configured for coupling with an associated surface portion of an associated one of the first and second jambs, and a second portion having two segments that are each coupled to corresponding segments of the first portion, each second portion lying at an angle equal to the predetermined angle from the other second portion and second portion being configured for positioning about the intermediate portions of one of the first and second jambs.

23 Claims, 6 Drawing Sheets

U.S. PATENT DOCUMENTS 2,854,843 A * 10/1958 Lamb ..... 52/210
2,893,235 A 7/1959 Goldberg
2,918,153 A * 12/1959 Hammitt et al. ..... 403/295
2,942,703 A 6/1960 Nelsson
3,269,068 A * 8/1966 King ..... 52/217
3,451,178 A * 6/1969 Beale ..... 52/210
3,517,473 A 6/1970 Kistner et al.
3,552,085 A * 1/1971 Woodrum ..... 52/211
3,571,995 A * 3/1971 Kasprzak ..... 52/212
3,654,734 A * 4/1972 Lehman ..... 49/505
3,769,773 A * 11/1973 Mochizuki ..... 52/656.4
3,886,688 A * 6/1975 Ragland ..... 49/504
4,067,157 A * 1/1978 Robinson ..... 52/127.2
4,126,975 A 11/1978 Williams
4,228,630 A * 10/1980 Englert et al. ..... 52/656.9
4,280,308 A 7/1981 Svensson
4,430,831 A 2/1984 Kemp
4,442,644 A * 4/1984 Jukes ..... 52/213
4,445,264 A 5/1984 Banerian
4,589,624 A 5/1986 Jones
4,756,135 A 7/1988 Citrullo et al.
4,813,204 A 3/1989 Rentschler
4,878,325 A 11/1989 Van Tuyl et al.
4,912,879 A 4/1990 Mozuras et al.
4,986,044 A 1/1991 Funari
5,063,721 A 11/1991 Larsson
5,070,651 A 12/1991 Jeter
5,090,168 A 2/1992 Fast et al.
5,098,243 A 3/1992 Buck
5,169,544 A 12/1992 Stanfill et al.
5,203,130 A 4/1993 Freelove
5,233,802 A * 8/1993 Rogers ..... 52/212
5,345,722 A 9/1994 McKann
5,412,909 A 5/1995 Wu
5,444,947 A 8/1995 Miller
5,465,538 A 11/1995 Powers, Jr.
5,588,266 A 12/1996 Headrick
5,671,580 A * 9/1997 Chou ..... 52/656.4
5,711,120 A 1/1998 Karpen
5,729,942 A 3/1998 Moore, Jr.
5,746,033 A 5/1998 Chuang
5,746,120 A 5/1998 Jonsson
5,791,103 A 8/1998 Coolman et al.
5,881,510 A 3/1999 Ole
5,890,339 A * 4/1999 Willis ..... 52/640
5,921,056 A 7/1999 Weiss et al.
5,927,039 A * 7/1999 De Boer ..... 52/656.9
5,934,030 A 8/1999 McDonald
5,996,283 A 12/1999 Maier
6,070,375 A 6/2000 Anderson et al.
6,308,476 B1 10/2001 Nakamoto et al.
6,341,465 B1 * 1/2002 Riegelman ..... 52/656.9
6,343,448 B1 2/2002 Lin
6,367,209 B1 4/2002 Powers, Jr.
6,401,402 B1 * 6/2002 Williams ..... 52/58
6,401,406 B1 * 6/2002 Komara ..... 52/127.3
6,453,620 B1 9/2002 Williams et al.
6,530,185 B1 3/2003 Scott et al.
6,560,938 B1 5/2003 Powers, Jr.
6,595,497 B1 7/2003 Linford et al.
6,609,340 B2 8/2003 Moore, Jr. et al.
6,609,349 B2 8/2003 Davidsaver
6,643,988 B1 11/2003 Armstrong et al.
6,698,156 B2 * 3/2004 Quarrels et al. ..... 52/742.16
7,223,044 B2 * 5/2007 Quintile ..... 403/402
7,299,590 B1 * 11/2007 Gibbs ..... 52/127.2
2003/0056452 A1 * 3/2003 Plsek et al. ..... 52/220.8
2004/0231263 A1 11/2004 McKay
2005/0055926 A1 3/2005 Ben-Lulu
2005/0201785 A1 9/2005 Gila et al.
2006/0174588 A1 8/2006 Anderson et al.
2006/0248823 A1 11/2006 Bollinger et al.

FOREIGN PATENT DOCUMENTS

GB 2397588 7/2004

* cited by examiner

SYSTEMS AND METHODS FOR FINISHING A PENETRATION IN A CONCRETE STRUCTURE DURING CONSTRUCTION

CROSS-REFERENCE TO RELATED APPLICATIONS

This application claims the benefit of U.S. Provisional Application No. 61/028,775, filed on Feb. 14, 2008, which is incorporated herein by reference.

FIELD

The present disclosure relates to building materials and systems and, more specifically, to systems and methods associated with finishing a penetration during construction such as for forming a window, door, or utility access opening in concrete or masonry structures such as walls and floors.

BACKGROUND

The statements in this section merely provide background information related to the present disclosure and may not constitute prior art.

As is known in the construction art, modern building construction often includes construction of concrete structure with insulated concrete forms (ICF's) that are composed either from a foam insulating material that form permanent concrete form walls or from concrete masonry construction (CMU). ICF construction sandwiches a heavy, high-strength reinforced concrete between two layers of a light, high-insulation foam. This combination creates a wall with an unusually good combination of desirable properties: air tightness, strength, sound attenuation, insulation, and mass. CMU typically utilizes concrete block or concrete brick in the formation of walls.

Concrete structures such as ICF walls and floors are constructed by placing separate ICF building blocks on each other. Rebar is placed within a cavity formed by the ICF blocks. Concrete is then poured and the walls are formed with the ICF blocks being left in place, even after the concrete hardens. The concrete wall so formed can include foundation walls and other building walls. For ICF construction, further insulation is generally not necessary. Additionally, floors and roofs can be poured using ICF construction techniques. CMU walls are formed by laying concrete blocks or bricks as masonry products. CMU and ICF walls can be externally finished such as with veneers, stucco, gypsum boards, and brick on the interior and exterior of the wall as required.

ICF blocks are typically made with two opposing expanded polystyrene side panels that are arranged in spaced parallel relationship with their inner surfaces facing each other to form a cavity therein. Plastic or metal bridging members can be molded into the side panels to hold them together to form the blocks and to hold them against the forces applied by the poured concrete within the cavity. Typically, an end plate is molded within each side panel as an internal "stud" for attachment of finishing materials. The bridges are typically attached to these end plates for structural support during the pouring of the concrete and for anchoring the endplate into the cured concrete. Rebar is often placed horizontally and vertically within the cavities of the ICF blocks before the concrete is poured. The purpose of using rebar is to hold the concrete in compression to provide added strength. CMU blocks or bricks are typically constructed similar to brick walls and typically include mortar between each adjacent CMU unit.

As these ICF and CMU blocks are stacked to form a wall, it is often necessary to form penetrations such as openings for doors, windows, utilities, HVAC ducts and other mechanical systems. These penetrations are often formed with block-out systems known as "bucks" that provide the openings as required by the ICF or CMU construction techniques, such as with an ICF wall before and after the concrete is poured, or before or during stacking of the CMU blocks. As with traditional construction, bucks have been utilized to provide such a block-out opening in the wall. Many of these conventional bucks are removable once the concrete has hardened, similar to the wood forms. These are often referred to as "reusable bucks".

These bucks are typically built as wooden framed bucks that provide the opening in the wall. These can be removable or can be left in place similar to the ICF or CMU blocks. If left in place after the wall or floor is constructed and cured, this wooden frame of the buck provides a fastening surface for the window or door and its finishing trim. The buck typically retains the concrete and also provides a point of attachment for interior and exterior finishes around the edge of the openings. In order to keep the wood frame properly aligned in the opening within the stacked wall forms, one or more temporary braces can also be used. These typically help to provide alignment of the wall forms with the wood frame. The buck typically requires supplemental bracing inside its frame to prevent deflection of the wood members under pressure from the poured concrete. This is usually accomplished by temporarily placing a brace between one or more sides of the buck opening.

When the buck frame is to be left in the wall, it is typically secured to the concrete by one or more fasteners, such as nails or anchor bolts. These are positioned prior to the pouring of the concrete and are secured to the frame and left hanging between the sides of the penetration during construction. The subsequent construction such as pouring of wet concrete into the cavity of an ICF wall can cause the concrete to flow around the fasteners and partially secure the buck frame in place once the concrete has hardened. Similarly, during CMU construction the mortar typically partially secures the frame to the CMU blocks about the penetration.

Such bucks have been traditionally constructed of wood and plastic. However, these bucks have demonstrated a variety of problems. For instance, wood bucks are known to change dimensions over time as a result of variations in humidity, temperature, and pressure, such as during the actual construction process. Plastic bucks have been shown to deform similarly, especially over time. Additionally, these plastic and wood bucks are not configured to endure substantial stress and do not offer strong bonds to the wall and as such can become easily dislodged from the wall.

As a result of the foregoing problems and disadvantages, there is a need in building construction for a more efficient, cost-effective and reliable systems and methods for finishing doors and windows in concrete walls and ceiling made with insulated concrete forms or concrete blocks.

SUMMARY

The inventors hereof have succeeded at designing edge finishing assemblies and methods that are capable of utilization during the construction of concrete structures such as ICF and CMU walls, floors, and roofs. These assemblies and methods can, in some embodiments, provide for improved construction practices and structures that include integrated structural support for roofing and windows and doors, improved edge finishes, and reduced construction costs, among other benefits and improvements.

Generally, this disclosure addresses various assemblies for finishing a penetration in a concrete structure during construction of the concrete structure. The assemblies are improvements on a winding edge system having a plurality of jambs forming the penetration configured with at least one elongated body having two surface portions coupled together with an intermediate portion positioned between the two surface portions in a substantially parallel position. The intermediate portion is dimensioned for enclosing an end of a side panel of a concrete block and a portion of the concrete within the structure. One of the two parallel surface portions is dimensioned for covering a portion of the side panel proximate to the end. A plurality of retention members are positioned along the at least one elongated body, each being adapted for receiving and securing a coupling device for coupling to an internal structural support member within the concrete of the structure.

One aspect is an assembly for finishing a penetration in a concrete structure during construction having at least one elongated body with two surface portions or surfaces coupled together with an intermediate portion positioned between the two surface portions in a substantially parallel position. The intermediate portion is dimensioned for enclosing an end of a side panel of a construction block and a portion of the concrete or mortar of the structure and one of the two parallel surface portions is dimensioned for covering a portion of the side panel proximate to the end. A plurality of retention members is positioned along the at least one elongated body, with each retention member being adapted for receiving and securing a coupling device for coupling to an internal structural support member within the concrete or mortar of the structure. The assembly includes a jamb connector configured for coupling a first jamb with a second jamb that is adjacent to the first jamb. The jamb connector having a first portion with two segments lying substantially in a same plane and positioned at a predetermined angle from each other. Each first portion segment is configured for coupling with an associated surface portion of an associated one of the first and second jambs. A second portion having two segments that are each coupled to corresponding segments of the first portion. Each second portion lies at an angle equal to the predetermined angle from the other second portion. The second portion is configured for positioning about the intermediate portions of one of the first and second jambs.

According to another aspect, an assembly for finishing a penetration in a concrete structure during construction, with one of a plurality of jambs having an inspection port having two ends defining a predetermined length formed along one of the two surface portions and at least a portion of the intermediate portion. An inspection plate has a mating surface portion and a mating intermediate portion with each mating with the corresponding portion of the jamb having the inspection port. The inspection plate has a length greater than the predetermined length of the inspection port such that a portion of the inspection plate overlaps at each end of the inspection portion. Fasteners are configured for coupling the inspection plate to the jamb having the inspection port and for covering the inspection port.

According to yet another aspect, at least two jambs are vertical jambs forming vertical uprights of a penetration in a concrete structure during construction of the concrete structure. An anchor bracket is fixedly attached to the intermediate portion of a bottom end of each vertical jamb. The anchor bracket has a foot portion adapted for securing to a mounting fixture for at least temporarily affixing the position of the vertical jamb relative to another vertical jamb.

In yet other aspects, the current disclosure includes the methods of manufacturing and using the assemblies as described above and herein. Further aspects of the present disclosure will be in part apparent and in part pointed out below. It should be understood that various aspects of the disclosure may be implemented individually or in combination with one another. It should also be understood that the detailed description and drawings, while indicating certain exemplary embodiments, are intended for purposes of illustration only and should not be construed as limiting the scope of the disclosure.

BRIEF DESCRIPTION OF THE DRAWINGS

It should be understood that throughout the drawings and the specification, corresponding reference numerals and/or text labels indicate like or corresponding parts and features.

DETAILED DESCRIPTION

The following description is merely exemplary in nature and is not intended to limit the present disclosure or the disclosure's applications or uses.

Generally, this disclosure addresses various assemblies for finishing a penetration in a concrete structure during construction of the concrete structure. The assemblies are improvements on a penetration edging system having a plurality of jambs forming the window or door configured with at least one elongated body having two surface portions coupled together with an intermediate portion positioned between the two surface portions in a substantially parallel position. The intermediate portion is dimensioned for enclosing an end of a side panel of a concrete block (such as an ICF or CMU block) and a portion of the concrete structure being built by the concrete blocks. One of the two parallel surface portions is dimensioned for covering a portion of the side panel proximate to the end. A plurality of retention members are positioned along the at least one elongated body, each being adapted for receiving and securing a coupling device for coupling to an internal structural member within the concrete structure.

In some embodiments, an assembly for finishing a penetration such a window and door or utility opening for an ICF or CMU wall includes a jamb connector configured for coupling a first jamb with a second jamb that is adjacent to the first jamb. The jamb connector has a first portion with two segments lying substantially in a same plane and positioned at a predetermined angle from each other. Each first portion segment being configured for coupling with an associated surface portion of the adjacent first or second jamb. A second portion has two segments that are each coupled to corresponding segments of the first portion. The second portion segments lie at an angle equal to the predetermined angle from each other. Each second portion is configured for positioning about the intermediate portions of one of the first and second adjacent jambs.

Figure 1:
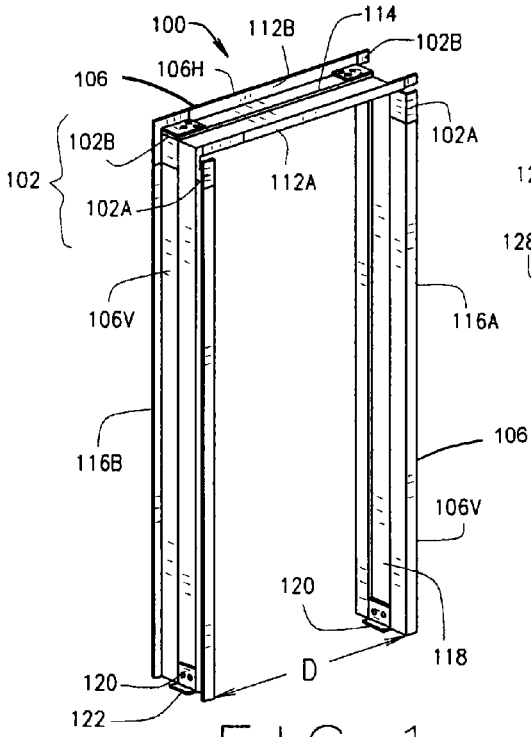
FIG. 1 is a side perspective view of an ICF framing assembly having utilizing both jamb connectors and anchor brackets according to two exemplary embodiments.
Figure 3:
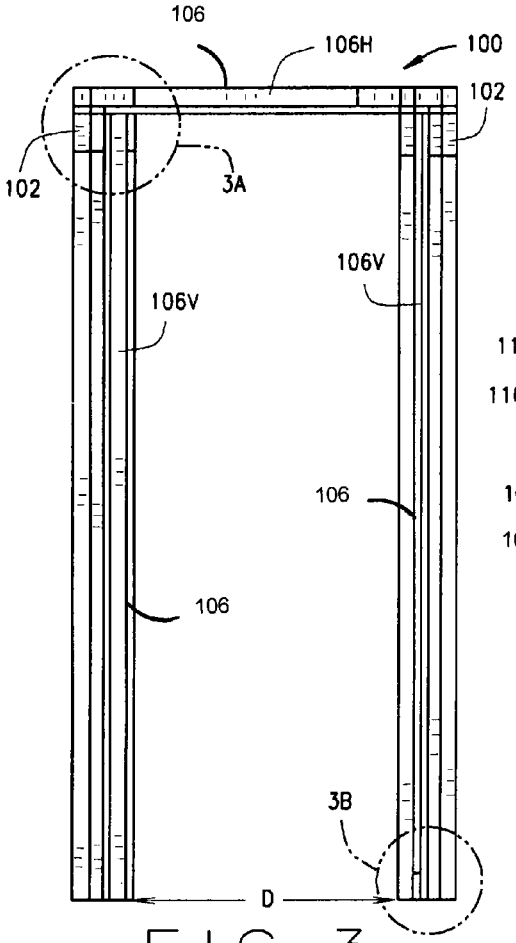
FIG. 3 is a front view of the ICF door assembly of FIG. 1 including illustrating details within FIGS. 3A and 3B.
Figure 4:
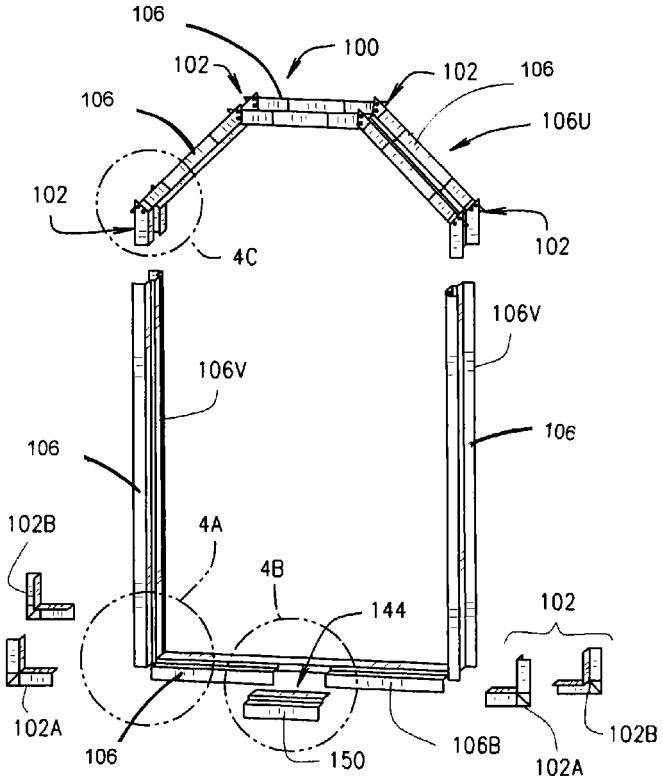
FIGS. 4, 4A, 4B and 4C are perspective views of an ICF framing assembly for an arched opening utilizing corner jamb connectors, angled jamb connectors and an inspection port and plate according to various exemplary embodiments.

Of course, it should be understood that more than one jamb connector can be used to connect two adjacent jambs, for example one on either side, such as front and back, of the jamb. Additionally, an opening in a concrete structure, whether a wall, floor or otherwise, typically has multiple jambs forming the opening and therefore multiple jamb connectors and/or sets of jamb connectors can be used to complete and finish the assembly. FIGS. 1 and 3 illustrate an exemplary door assembly having square corners configured with the jamb connector formed at 90 degrees. FIG. 4 illustrates an exemplary penetration of a door or window assembly configured with upper jamb connectors formed at greater than 90 degrees and lower jamb connectors formed at 90 degrees and tying into a bottom jamb.

It should be understood to those skilled in the art that while many of the exemplary embodiments described herein are shown for construction of an ICF wall, the same assemblies and methods apply to construction of ICF floors and roofs, as well as CMU walls, e.g., this can include both concrete and masonry wall construction as well as ICF wall construction. Additionally, the exemplary embodiments generally describe, by way of example, outside corners of penetrations/openings. However, the same assemblies and methods can apply to inside corners as well and are still considered to be within the scope of the present disclosure and claims.

In some embodiments, an edge assembly for a penetration in a concrete structure can include a jamb having an inspection port with two ends defining a predetermined length. The jamb can include a bottom jamb such as a kick jamb configured to positioning between two vertical jambs and for establishing and maintaining their distance relative to each other during and after construction. The inspection port can be formed along one of the two surface portions of the jamb and at least a portion of the intermediate portion. An inspection plate has a mating surface portion mating with corresponding surface portions of the jamb having the inspection port. A mating intermediate portion is configured for mating with the corresponding intermediate portion of the jamb having the inspection port. The inspection plate has a length that is greater than the predetermined length of the inspection port and is positioned such that a portion of the inspection plate overlaps at each end of the inspection portion. Fasteners couple the inspection plate to the jamb having the inspection port. When so positioned and fastened, the inspection plate covers the inspection port of the jamb. The inspection port can be left open during construction to aid construction such as for placement of masonry compounds, concrete or insulation in the wall being constructed. This inspection port can also be re-opened for construction inspection at a later time to ensure that the placement of the jamb and or the construction of the wall have been according to requirements or specifications.

In some embodiments, such as when an ICF or CMU wall finishing system is used to finish a door, utility opening, or a floor length window (generally referred to herein as an opening assembly having jambs but is intended to cover each of these arrangements), there are typically at least two jambs that are vertical that form vertical uprights of an opening, each vertical jamb having a top end and a bottom end. An anchor bracket can be attached to the intermediate portion of each bottom end of the two vertical jambs. The anchor bracket can have a foot adapted for securing to a mounting fixture such as a floor. Each foot of each anchor bracket is configured for at least temporarily affixing the position of the vertical jamb relative to the other vertical jamb when the foot portion is secured to the mounting fixture.

Referring now to the figures, FIGS. 1 and 3 illustrate an exemplary penetration assembly 100 for finishing a door or winding penetration in a concrete structure (not shown), such as a wall, using two pairs of 90-degree jamb connectors 102A, 102B, each pair having a jamb connector 102A and 102B coupled together to form a jamb connector pair 102, hereinafter wherein each connector of the pair is also referred individually as a jamb connector 102 or as jamb connectors 102A, 102B. Each jamb connector 102 can be coupled, for example, to two penetration jambs 106 such as to connect a vertical jamb 106V to an adjacent horizontal jamb 106H and to form the top corners of the assembly 100. It should be understood that other angles other than 90-degree square corners can be formed using the same type of jamb connectors 102. This can include, for inside or outside corners, between about 90 degrees to about 135 degrees. However, any other desired angle for an inside or outside corner can be used equally as well.

Figure 3A:
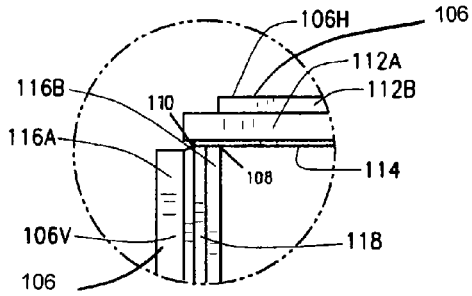

As shown in FIG. 3A. a horizontal jamb 106H is positioned having one end abutting with the upper end of a vertical jamb 106V at an intersection point 108 and forming an exterior corner 110. As shown, the horizontal jamb 106H has two opposing external side surfaces 112A, 112B and an intermediate section 114 therebetween. The vertical jamb 106V has two corresponding opposing external side surface 116A, 116B and an intermediate portion 118 therebetween. From this it can be seen that a first jamb connector 102A of a mated pair of jamb connectors 102 can be positioned about the exterior intersecting corner 110 for coupling the horizontal jamb 106H to the vertical jamb 106V by coupling external side surface 116A with external side surface 112A. Similarly, second jamb connector 102B of the mated pair of jamb connectors 102 can be coupled to both external side surface 116B and external side surface 112B.

Figure 3B:
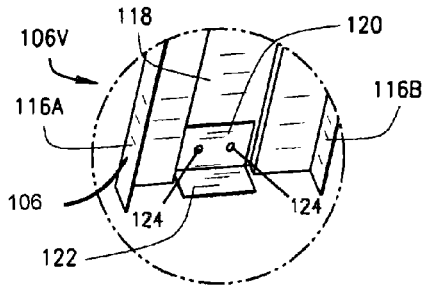

In the illustrated embodiments of FIG. 3, as also illustrated in supporting FIGS. 3A and 3B, anchor brackets 120 (shown in FIG. 3B) are positioned at the bottom end of each of the vertical jambs 106V. A foot 122 (as shown in FIGS. 1 and 3B) of the anchor brackets 120 are permanently or temporarily secured to a surface so that the distance D between the bottom ends of the vertical jambs 106V is maintained during construction of the wall (not shown), for example, during the pouring of the concrete in the ICF wall and around or about the jambs 106 defining a window or a door opening or penetration. When used in construction of a concrete masonry construction (CMU) wall, the anchor brackets 120 can be secured within mortar during the laying of the concrete blocks. It should be noted that each anchor bracket 120 as shown in FIGS. 1 and 3B can be fixedly attached to the bottom intermediate portion of each vertical jamb 106V by at least one fastener mechanism 124 (as shown by way of example in FIG. 3B) such as a screw or a weld. The anchor bracket 120 is typically mounted on the jamb towards the interior of the wall being formed. However, where it is only required for temporarily securing the jamb, the anchor bracket 120 can be placed on the jamb side facing into the penetration of the wall.

In other embodiments, each anchor bracket 120 can have a mounting fixture (not shown), other than the foot 122, that can be specifically adapted for affixing the bottom ends of the two vertical jambs 106V at a predetermined distance from each or to a surface during construction of the concrete structure including the pouring of concrete or placing of mortar about the connected jambs 106 or an mounting fixture that extends into a void filled by concrete or mortar (not shown). Such, mounting fixture can include a kick or bottom jamb, for example, and as will be discussed in more detail below, or an anchor fastener.

Figure 2A:
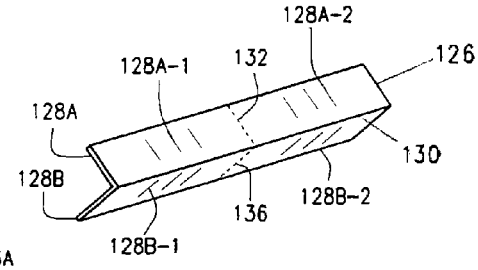
FIG. 2A is a side perspective view of a structure for fabricating a jamb connector according to one embodiment.
Figure 2B:
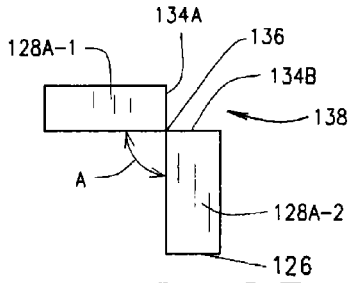
FIG. 2B is a front view of the jamb connector according to one exemplary embodiment.

Examples of the jamb connectors 102A and 102B, composing the two portions of the jamb connector pair 102, can be formed or manufactured in any manner, but are typically mirror images of each other, thereby providing for their mating on opposing sides of the jambs 106. As shown in FIGS. 2A and 2B, in one embodiment, each can be formed from a metal such as steel or a composite material including a plastic. As shown in FIGS. 2A, 2B, one exemplary method of maKing the jamb connectors 102A, 102B include cutting a linear portion 126 having two surface segments 128, shown as first surface 128A and second surface 128B, but referred herein generally as surface segments 128 (shown in FIG. 2A) formed by a joint 130 forming a right angle. The first surface 128A is cut at cut line 132, also referred herein as a cut 132, through to the joint 130 to form two first surface segments 128A-1 and 128A-2, each having a corresponding edge 134A and 134B defined by the cut 132. As shown in FIG. 2B, the second surface 128B is bent at an axis 136 located on the second surface 128B in line with the cut 132 to form the preferred angle A at axis 136 between two second surface segments 128B-1 and 128B-2. This bending to obtain angle A between the two second surface segments 128B-1 and 128B-2 separates the first surface segment 128A-1 from the first surface segment 128A-2 creating a void 138 therebetween. The angle A is formed during fabrication by rotating the second surface segment 128B-1 relatively the second surface segment 128B-2 about the axis 136. The void 138 is formed between edges 134A and 134B of the two first surface segments 128A-1 and 128A-2.

Figure 2C:
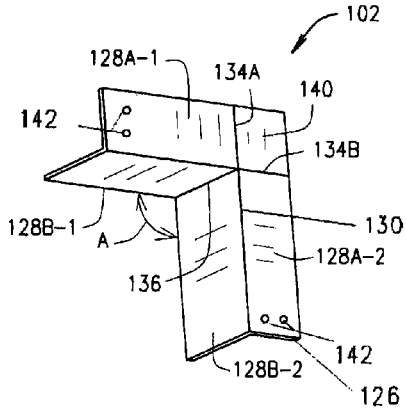
FIG. 2C is a back perspective view of a jamb connector according to one exemplary embodiment.

In the example of FIGS. 2A and 2B, the angle A is 90 degrees and the void 138 forms a square or rectangular shape with two adjacent sides defined by the two edges 134A and 134B that were formed from the cut 132. As shown in FIG. 2C, a corner plate 140 is fabricated from material which is a similar type of material and is coupled to the two first surface segments 128A-1 and 128A-2 to fill in the void 138 such as by soldering or welding. For example, a small square corner or rectangle plate 140 can be welded in the void 138 by welding two edges of the corner plate 140 to the two edges 134A and 134B respectively to form a contiguous planar first surface 128A having the first surface segment 128A-1 at angle A to first surface segment 128A-2. Additionally, as shown in FIG. 2C, the two segments of the second surface 128B-1 and 128B-2 are fixed at angle A relative to each other to form the corner connector 102A. One or more fastening holes 142 may also be formed on each of the first surface segments for receiving a fastener (not shown) for coupling attaching each jamb connector 102A, 102B to a jamb forming a corner.

This same process is used to form the mating jamb connector 102B by cutting of the second surface 128B instead of the first surface 128A and following the same procedures. The two similarly formed jamb connectors 102A and 102B are then mated on opposing sides of two jambs 106 to be connector together to form a corner of the penetration assembly 100.

In some embodiments, a jamb connector 102 for a penetration assembly 100 can be formed having the angle A of greater than 90 degrees. As shown in FIG. 4, a window or door way can be formed using four jamb connectors 102 each having an angle A greater than 135 degrees to form an arched upper jamb 106U mounted on top of two vertical jambs 106V. If desired, the penetration assembly 100 can also be formed with a pointed top utilizing a jamb connector 102 at the top having an angle that is less than 90 degrees. Such embodiments are considered to be within the scope of the present disclosure and will be addressed in further details below.

Additionally, FIG. 4 illustrates that a pair of 90 degree jamb connectors 102A, 102B can be utilized to couple to a bottom or kick jamb 106B to the two vertical jambs 106V. In such an embodiment, anchor brackets 120 may not be necessary as the bottom jamb 106B maintains the predetermined distance between the bottoms of the two vertical jambs 106V.

Figure 4A:
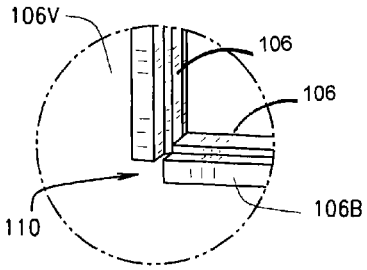

FIG. 4A illustrates an unfinished lower or bottom exterior corner 110 formed by the alignment of the bottom end of the vertical jamb 106V with an end of the bottom jamb 106B. The bottom exterior corner 110 is then covered by attachment of two opposing and mated corner connectors 102 as described above to form the bottom connected corner of penetration assembly 100 as illustrated in FIG. 4.

Figure 4B:
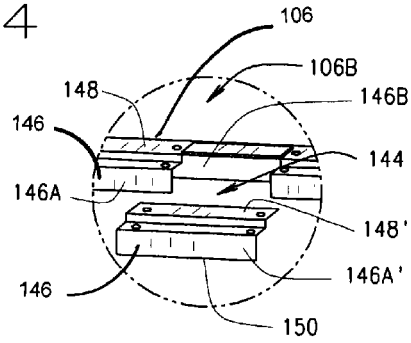

FIGS. 4 and 4B also includes an exemplary embodiment of an inspection port 144 along the bottom jamb 106B. As shown in this example, the inspection port 144 is along a front side surface 146 (shown as 146A) of the bottom jamb 106B. This inspection port 144 includes one of the outer surfaces 146A and a portion of the intermediate section 148. An inspection plate 150 is configured to seal the inspection port 144 and therefore has a similar shape such that when placed onto the bottom kick jamb 106B over the inspection port 144, the inspection plate 150 covers and/or seals the inspection port 144. The inspection plate 150 is configured to be contiguous with the surfaced of the bottom jamb 144 and therefore has corresponding portions front side surface 146A' and intermediate section 148' such that when the inspection plate 150 is secured to the bottom jamb 106B, such as temporarily or permanently by adhesives, screws, or by soldering or welding, the inspection plate 150 is integrated with the bottom jamb 106B. The inspection plate 150 can be left open during construction of the concrete structure having the opening. During such time, concrete or mortar can be inserted through the inspection port 144 or a vibrator can be inserted therein to ensure the concrete is positioned fully about the bottom jamb 106B and any voids are filled. Additionally, the inspection port 144 can be left open or opened to enable a building inspector or other person to inspect the penetration assembly 100 and the placement of concrete or mortar about the jambs 106. While illustrated as being only in the bottom jamb 106B, it should be understood that the inspection plate 144 can be formed on any jamb 106 of the penetration assembly 100 and not limited to the bottom jamb 106B.

Figure 4C:
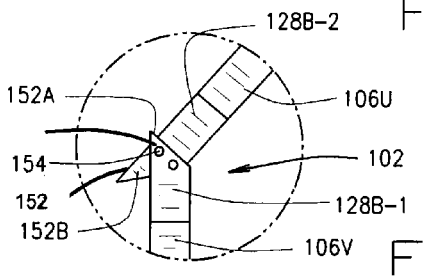

FIG. 4C illustrates the jamb connector 102 as shown in FIG. 4 having defining a jamb corner angle A of more than 90 degrees. As can be seen as an introduction, the jamb connector 102 in this illustration has been coupled between jamb 106U and 106V to form angle A. However, the jamb connector 102 includes an overlap area wherein each first surface segment 128A includes an ear 152, shown as first ear 152A and second ear 152B. The overlap is defined by overlapping ear 152A and 152B that are held in place by one or more fasteners 154 coupling the two overlapping ears 152A and 152B together for maintaining the angle A at more than 90 degrees.

FIGS. 5A-5C and 6A, 6B and 7 illustrate methods for fabricating the jamb connector 102 having an angle at greater than 90 degrees as shown in FIGS. 4 and 4C.

Figure 5A:
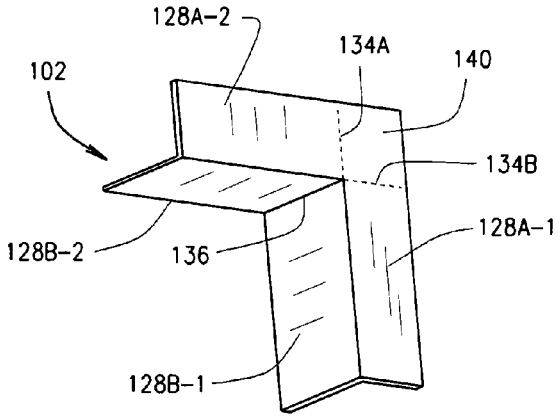
FIGS. 5A-5D are perspective and side views of a jamb connector being adapted for use in a 135 degree angled coupling of two adjacent jambs according to one exemplary embodiment.
Figure 5B:
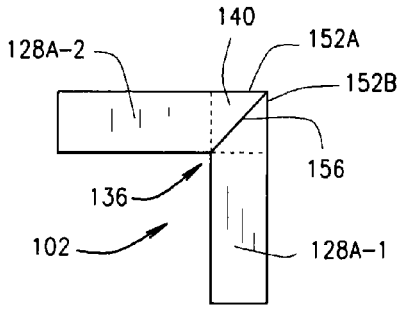
Figure 5C:
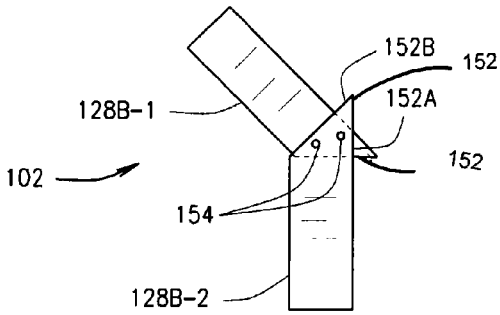
Figure 6A:
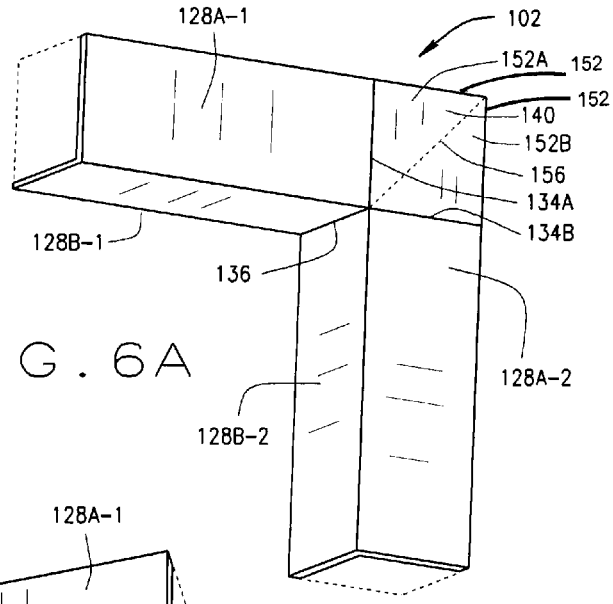
FIGS. 6A-6B are perspective views of jamb connectors according to some exemplary embodiments.
Figure 6B:
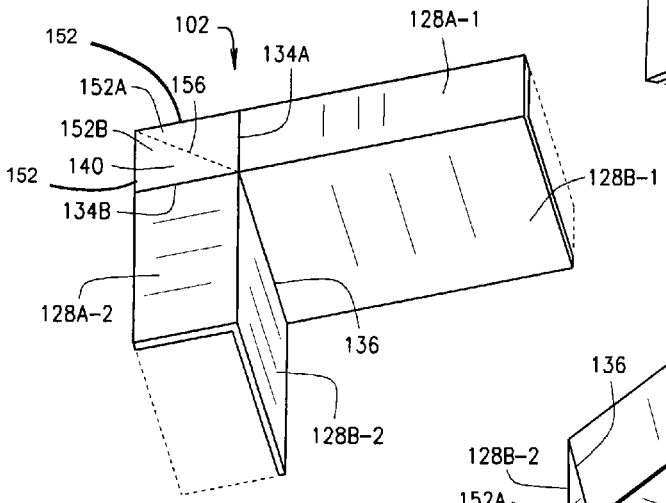
Figure 7:
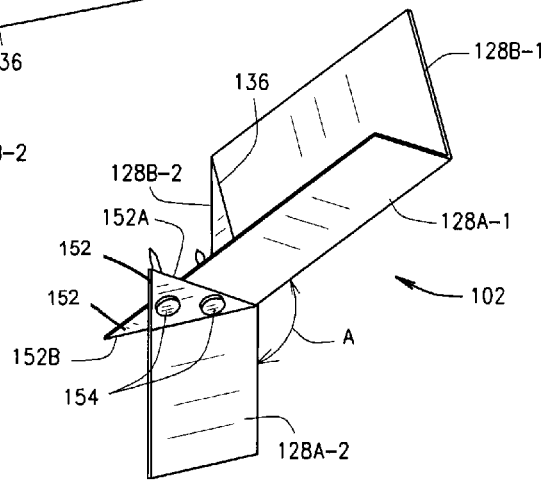
FIG. 7 is a perspective view of an angled jamb connector having a 135 degree predetermined angle and fasteners according to an exemplary embodiment.

As shown in FIGS. 5A, 6A, and 6B, a jamb connector 102 as described above having a 90 degree angle A is first fabricating as addressed above or by other methods known to those skilled in the art. Next, a cut 156 is made in the corner plate diagonally outwardly from the axis 136. Then as shown in FIGS. 5C and 7, similarly as to FIG. 4C, the 90 degree second surfaces 128B-1 and 128B-2 become free to rotate again about axis 136. The two second surfaces 128B-1 and 128B-2 can be rotated to increase angle A to the desired orientation. When doing so, ear 152A overlaps with 152B to form an overlapping portion. Once the desired angle A is achieved, the fasteners 154 can be applied to the overlapping ears 152 to secure ear 152A to ear 152B and secure angle A of the jamb connector 102. The fasteners 154 can be any fastener suitable for securing including, but not limited to screws, welding and adhesives, by way of example.

The two second surface angled segments 128B-1 and 128B-2 are configured to be parallel to the intermediate portion of the jambs 106 being coupled. In some embodiments, the second surfaces 128B can include a length such that it extends into a void formed by the two surfaces of the coupled jamb 106 and therefore into the concrete that is poured into the void during construction.

Figure 5D:
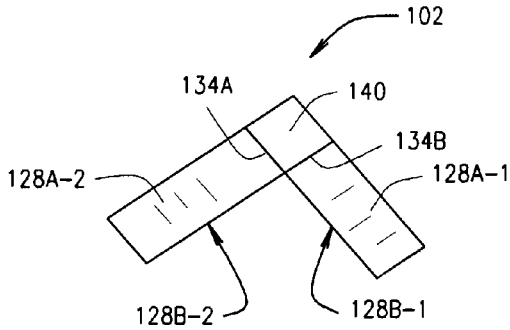

As shown in FIG. 5D, a jamb connector can also be formed wherein the angle A is less than 90 degrees. In such embodiments, the corner plate 140 can be dimensioned to have a shape other than a square or rectangle during the process of making the jamb connector. In such embodiments, the process as described above with regard to FIGS. 2A-2C can be modified so that the plate has a diamond shape for securing the two second segments 128B-1 and 128B-2 at less than a 90 degree angle A. In such embodiments, the corner plate 140 would not be a square as utilized for fabricating a right angle corner, but would have a rhombus shape. In other embodiments, the right angle jamb connector 102 as shown in FIGS. 6A and 6B, can have a second plate (not shown) inserted between the two ears 152. The second plate once secured by welding or otherwise would be similar to the first plate 140, but would secure the jamb connector at an angle A that is less than 90 degrees. The second plate would have a triangular shape to fill the void defined by the cut 156 and further rotation about axis 136.

Figure 8A:
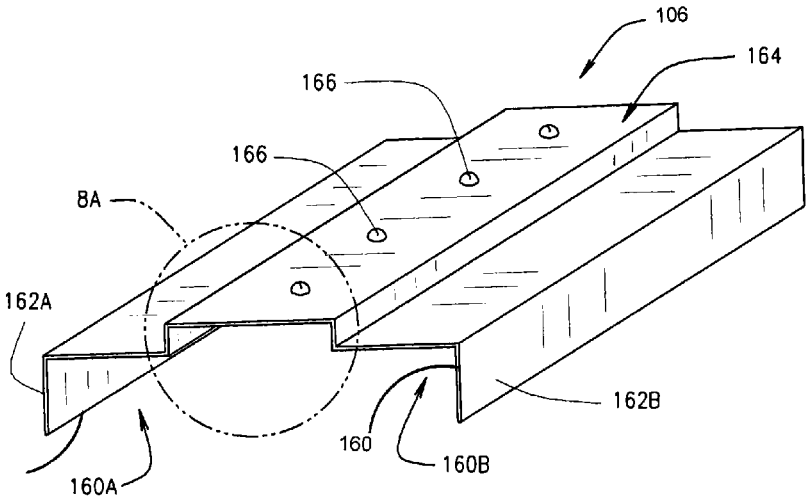
FIGS. 8A-8C are various views of an ICF jamb suitable for use with some of the jamb connectors, inspection port and plate and anchoring brackets of some embodiments.
Figure 8B:
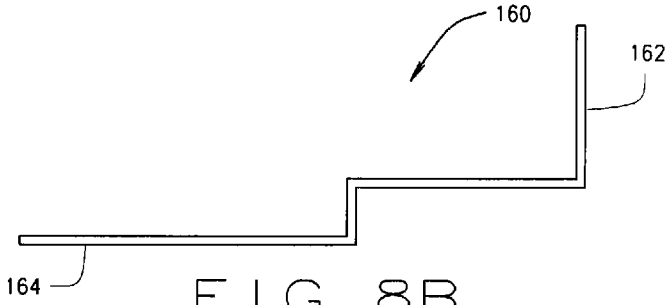
Figure 8C:
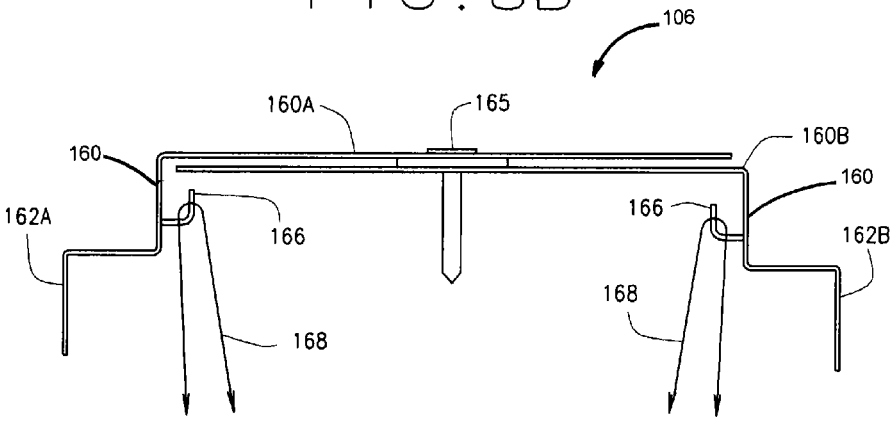

FIGS. 8A-8C illustrate for completeness, one exemplary embodiment of a jamb 106 suitable for use of jamb connectors 102 in finishing the corners of penetration assembly 100. As shown, the jamb 106 includes two side portions 160, which are illustrated in the figures as portions 160A and 160B. Each side portion 160 (shown as side portions 160A and 160B) includes an exterior surface 162 and an intermediate surface 164. The two side portions 160 that are shown as side portions 160A and 160B are positioned so that the intermediate surfaces 164A and 164B overlap. Fasteners 165 secure the two overlapped intermediate surfaces 164A and 164B together and thereby define a distance between the two exterior surfaces 162A and 162B. The fasteners 165 can be any suitable fasteners, including a screw, rivet, bolt, and adhesive, by way of examples. Such distance can be adjusted during construction to correspond to the desired width of the jamb 158 to match the width of the wall in which the jamb 106 is being used to finish a penetration. As shown in FIG. 8C, securing members 166 can be formed on an inner surface of each side portion 160 which are shown as the two side portions 160A and 160B for receiving a tying member 168 that is coupled to an internal structure of the wall being constructed. These securing members 166 and tying members 168 can be positioned along the length of the jamb 106 including the areas in close proximity to the jamb connectors 102 and the intersection of one jamb 106 with another jamb 106, such as the above jambs 106, including 106H, 106V, 106U, and 106B, by way of examples. In such embodiments the securing members 166 and tying members 168, once securing within a structure of the wall being constructed will aid in stabilizing the penetration assembly 100 both before and after construction of the wall.

From the above discussion, one or more benefits of the jamb connectors, inspection port and plate and anchor bracket should be known to those skilled in the art. One or more embodiments of these can provide for improved and less costly construction of a concrete structure having a penetration therein such as for finishing a window, door or utility opening such that the construction process is improved and the finished opening is as planned and expected. Additionally, the methods of using the jamb connector, inspection port and plate, and anchor brackets during the construction and finishing of an opening in a concrete structure during construction of the concrete structure are also included within the scope of the present disclosure.

Further, as should be known to those skilled in the manufacturing and construction arts after reviewing this disclosure and the drawing figures, the methods of manufacturing the jamb connectors, inspection port, inspection plate and anchor bracket are also within the scope of the present disclosure.

When describing elements or features and/or embodiments thereof, the articles "a", "an", "the", and "said" are intended to mean that there are one or more of the elements or features. The terms "comprising", "including", and "having" are intended to be inclusive and mean that there may be additional elements or features beyond those specifically described.

Those skilled in the art will recognize that various changes can be made to the exemplary embodiments and implementations described above without departing from the scope of the disclosure. Accordingly, all matter contained in the above description or shown in the accompanying drawings should be interpreted as illustrative and not in a limiting sense.

It is further to be understood that the processes or steps described herein are not to be construed as necessarily requiring their performance in the particular order discussed or illustrated. It is also to be understood that additional or alternative processes or steps may be employed.

What is claimed is:

1. An assembly for finishing a penetration in a concrete structure during construction using insulated concrete form (ICF) construction blocks having two opposing side panels defining a cavity for receiving concrete therein, the assembly comprising:

a first jamb and a second jamb that is adjacent to the first jamb, each jamb having at least one elongated body having two opposing surface portions coupled together with an intermediate portion positioned between the opposing two surface portions in a substantially parallel position, the intermediate portion dimensioned for enclosing an end of a side panel of one or more of the ICF construction blocks and at least a portion of the cavity therein before, during and after placement of concrete into the cavity and wherein one of the two parallel surface portions is dimensioned for covering a portion of the side panel proximate to the end and a plurality of securing members positioned along the at least one elongated body towards the empty cavity of the ICF construction blocks, each elongated body being adapted for receiving and securing a tying member for coupling to an internal structural support member within the cavity of the ICF construction blocks before, during and after placement of the concrete into the cavity; and a jamb connector coupling an outer surface of an end of one of the surface portions of the first jamb with an outer surface of an end of a corresponding surface portion of the second jamb that is adjacent to the first jamb, said coupling being at one of a plurality of possible angles relative to each other, the jamb connector having a first portion with two segments lying substantially in a same plane and positioned at a selected angle from among the plurality of possible angles from each other, each first portion segment being configured for coupling with an associated surface portion of an associated one of the elongated bodies of the first and second jambs, and a second portion having two segments that are each coupled to corresponding segments of the first portion, each second portion lying at the selected angle from the other second portion and each second portion positioned about the intermediate portions of one of the first and second jambs.

2. The assembly of claim 1 wherein the jamb connector is configured for defining at least one of an inside corner and an outside corner of the penetration in the concrete structure.

3. The assembly of claim 1 wherein the jamb connector defines an inside corner and wherein the selected angle is about 90 degrees.

4. The assembly of claim 1 wherein the jamb connector defines an outside corner and the selected angle is about between about 90 degrees and about 135 degrees.

5. The assembly of claim 4 wherein a portion of the first segment and second segments of the first portion overlap.

6. The assembly of claim 1 wherein the jamb connector is a first jamb connector corresponding to first associated first portions and providing a first coupling of the end of the first jamb to the end of the adjacent second jamb at the selected angle from among the plurality of possible angles on a first outer surface portion of the opposing surface portions, further comprising:

a second jamb connector providing a second coupling of the end of the first jamb with the end of the second jamb on the opposing outer surface portions of the first and second jambs as compared to the first outer surface portion, said coupling being at one of a plurality of possible angles relative to each other, the second jamb connector having a first portion with two segments positioned in a same plane and positioned at the same selected angle from among the plurality of angles as the first jamb connector from each other with each segment of the first portion of each second jamb being configured for coupling with an associated surface portions of one of the first and second jambs, and a second portion having two segments that are each coupled to a corresponding segment of the first portion at the selected angle, each second portion being configured for positioning about the intermediate portion of one of the first and second jambs.

7. The assembly of claim 6 wherein a portion of the first segment and second segments of the first portion of each of the first and second jamb connectors overlap.

8. The assembly of claim 7, further comprising a fastener coupling the overlapping first and second segments of each of the first and second jamb connectors.

9. The assembly of claim 1, further comprising a plurality of fasteners coupling the jamb connector to each of the first and second jambs.

10. The assembly of claim 9 wherein the fasteners are screws.

11. The assembly of claim 9 wherein the fasteners couple each of the two segments of the first portions to the coupled associated surface portions of the first and second jambs.

12. The assembly of claim 1 wherein the jamb connector includes a corner plate forming an outer corner coupling the first segment to the second segment to select the angle from among the plurality of possible angles and positioned in the same plane as the first and second segments.

13. The assembly of claim 12 wherein the first and second jambs and the jamb connector are each composed of metal and wherein the corner plate is welded to each of the metal segments of the first portion of the jamb connector for providing structural strength to the selected angle.

14. The assembly of claim 1 wherein the jamb connector includes a corner plate forming a coupling between the first segment and the second segment to define the selected angle from among the plurality of angles.

15. The assembly of claim 14 wherein the first and second jambs and the jamb connector are each composed of metal and wherein the corner plate is welded to each of the metal segments of the first portion of the jamb connector for providing structural strength to the selected angle.

16. The assembly of claim 1 wherein each segment of the second portion is coupled to a corresponding segment of the first portion at a right angle.

17. The assembly of claim 1 wherein the two segments of the second portion are configured for protruding into a void defined at least in part by the intermediate portions of one of the first and second adjacent jambs.

18. An assembly for finishing a penetration in a concrete structure during construction using insulated concrete form (ICF) construction blocks having two opposing side panels defining a cavity for receiving concrete therein, the assembly comprising:

a plurality of jambs forming the penetration configured with at least one elongated body having two surface portions coupled together with an intermediate portion positioned between the two surface portions in a substantially parallel position, the intermediate portion dimensioned for enclosing an end of a side panel of one or more of the ICF construction blocks and at least a portion of the cavity therein before, during and after placement of concrete into the cavity and wherein one of the two parallel surface portions is dimensioned for covering a portion of the side panel proximate to the end and a plurality of securing members positioned along the at least one elongated body towards the empty cavity of the ICF construction blocks, each being adapted for receiving and securing a tying member for coupling to an internal structural support member within the cavity before, during and after placement of the concrete into the cavity, wherein one of the jambs includes an inspection port having two ends defining a predetermined length formed along one of the two surface portions and at least a portion of the intermediate portion for inspecting the cavity before, during and after placement of the concrete into the cavity;

a jamb connector coupling an end of a first of the plurality of jambs with an end of a second of the plurality of jambs that is adjacent to the end of the first jamb, said coupling being at one of a plurality of possible angles relative to each other, the jamb connector having a first portion with two segments lying substantially in a same plane and positioned at a selected angle from among the plurality of possible angles from each other, each first portion segment coupling with an associated outer surface of the surface portion of an associated one of the elongated bodies of the first and second jambs, and a second portion having two segments that are each coupled to corresponding segments of the first portion, each second portion lying the selected angle from the other second portion and second portion positioned about the intermediate portions of one of the first and second jambs;

an inspection plate positioned about the inspection port in the one jamb, the inspection plate having a mating surface portion and a mating intermediate portion, each mating with the corresponding portion of the jamb having the inspection port, the inspection plate having a length greater than the predetermined length of the inspection port such that a portion of the inspection plate overlaps at each end of the inspection portion; and a plurality of fasteners coupling the inspection plate to the jamb having the inspection port securing the covering of the inspection port by the inspection plate.

19. The assembly of claim 18 wherein the fasteners are screws and wherein the inspection plate is configured for removal.

20. The assembly of claim 18 wherein the fasteners are welds and wherein the inspection plate is configured to be permanently affixed to the jamb by the welds following pouring of concrete into the cavity of the ICF block.

21. An assembly for finishing a penetration in a concrete structure during construction using insulated concrete form (ICF) construction blocks having two opposing side panels defining a cavity for receiving concrete therein, the assembly comprising:

a plurality of paired adjacent jambs forming the penetration configured with each jamb having at least one elongated body having two surface portions coupled together with an intermediate portion positioned between the two surface portions in a substantially parallel position, the intermediate portion dimensioned for enclosing an end of a side panel of one or more of the ICF construction blocks and at least a portion of the cavity therein before, during and after placement of concrete into the cavity and wherein one of the two parallel surface portions is dimensioned for covering a portion of the side panel proximate to the end and a plurality of securing members positioned along the at least one elongated body towards the empty cavity of the ICF construction blocks, each securing member being adapted for receiving and securing a tying member for coupling to an internal structural support member within the cavity of the ICF blocks before, during and after placement of the concrete into the cavity, wherein one of the jambs includes an inspection port having two ends defining a predetermined length formed along one of the two surface portions and at least a portion of the intermediate portion for inspecting the cavity before, during and after placement of the concrete into the cavity;

a jamb connector coupling an adjacent end of a first one of an adjacent pair of jambs with an end of the second one of the adjacent pair of jambs, each said coupling of a pair of adjacent jambs of the assembly being at one of a plurality of possible angles relative to each other, each the jamb connector having a first portion with two segments lying substantially in a same plane and positioned at a selected angle from among the plurality of possible angles from each other, each first portion segment coupling with an outer surface of the associated surface portion of an associated one of the elongated bodies of the first and second jambs, and a second portion having two segments that are each coupled to corresponding segments of the first portion, each second portion lying the selected angle from the other second portion and second portion positioned about the intermediate portions of one of the first and second jambs;

an inspection plate positioned about the inspection port in the one jamb, the inspection plate having a mating surface portion and a mating intermediate portion, each mating with the corresponding portion of the jamb having the inspection port, the inspection plate having a length greater than the predetermined length of the inspection port such that a portion of the inspection plate overlaps at each end of the inspection portion; and a plurality of fasteners coupling the inspection plate to the jamb having the inspection port securing the covering of the inspection port by the inspection plate;

wherein at least two jambs each of a different pair of adjacent jamb pairs includes only one of the first and second jambs are vertical jambs forming the vertical uprights of the penetration, each vertical jamb having a bottom end; and an anchor bracket fixedly attached to the intermediate portions of each bottom end of each vertical jamb, the anchor bracket having a foot portion adapted for securing to a mounting fixture for at least temporarily affixing the position of the vertical jamb relative to another of the vertical jambs before pouring of the concrete into the cavity of the ICF blocks.

22. The assembly of claim 21 wherein each anchor bracket is fixedly attached to the bottom intermediate portion of each vertical jamb by at least one of a screw or a weld.

23. The assembly of claim 21 wherein each anchor bracket has a mounting fixture adapted for affixing the bottom ends of the two vertical jambs at a predetermined distance from each during construction of the concrete structure including before, during and after the pouring of concrete into the cavity.

* * * * *